US006848480B2

(12) United States Patent
Brennan

(10) Patent No.: US 6,848,480 B2
(45) Date of Patent: Feb. 1, 2005

(54) FILLING PROCESS FOR DUAL FLUID CARTRIDGE ASSEMBLIES

(75) Inventor: Robert Charles Brennan, Bordentown, NJ (US)

(73) Assignee: TAH Industries, Inc., Robbinsville, NJ (US)

( * ) Notice: Subject to any disclaimer, the term of this patent is extended or adjusted under 35 U.S.C. 154(b) by 0 days.

(21) Appl. No.: 10/755,796

(22) Filed: Jan. 12, 2004

(65) Prior Publication Data

US 2004/0261888 A1 Dec. 30, 2004

(51) Int. Cl.[7] ..... B65B 1/04

(52) U.S. Cl. ..... 141/2; 141/18; 141/27; 141/59; 141/100; 141/325

(58) Field of Search ..... 141/2, 9, 18, 25–27, 141/59, 100, 247, 325, 326; 222/129, 137, 145.1, 251

(56) References Cited

U.S. PATENT DOCUMENTS 4,220,261 A 9/1980 White
4,961,520 A 10/1990 White
5,184,758 A * 2/1993 Keller ..... 222/137
5,310,091 A 5/1994 Dunning et al.
6,422,427 B2 * 7/2002 Brown et al. ..... 222/255

* cited by examiner

*Primary Examiner*—Timothy L. Maust
(74) *Attorney, Agent, or Firm*—Katten Muchin Zavis Rosenman; John S. Paniaguas

(57) ABSTRACT

A method for filling a dual fluid cartridge assembly which automatically bleeds air from the cartridge to filling and without extra steps or a vacuum as in known filling methods. In particular, the process relates to providing a dual fluid cartridge assembly which includes vents that bleed air from the cartridges initially and automatically closes the vents as the piston seal moves away from the vent. By utilizing such a self-bleeding cartridge assembly, the cartridge can be filled by a fluid dispenser without the need for shims, a vacuum or bleed plugs.

3 Claims, 8 Drawing Sheets

Fig. 2
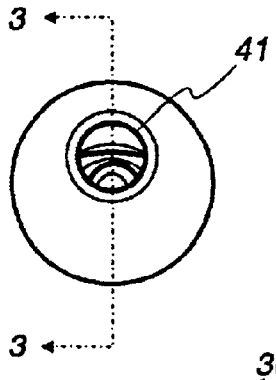
Fig. 3
(FILLED)
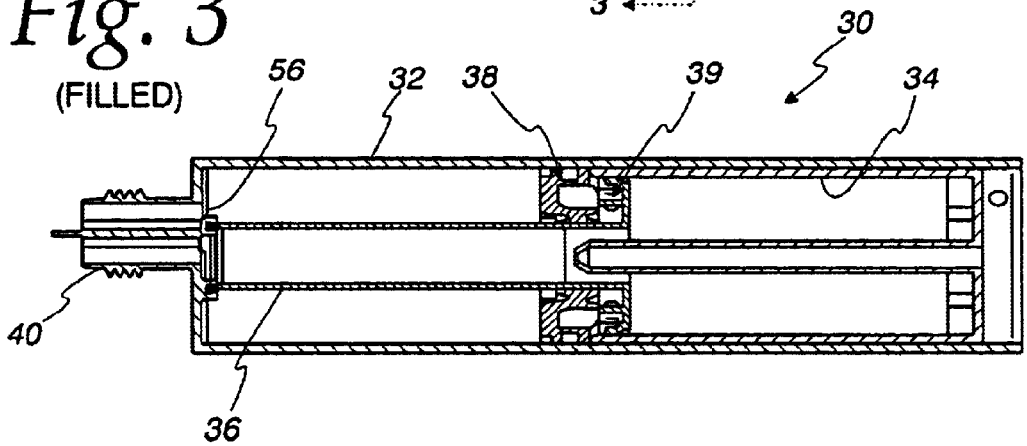
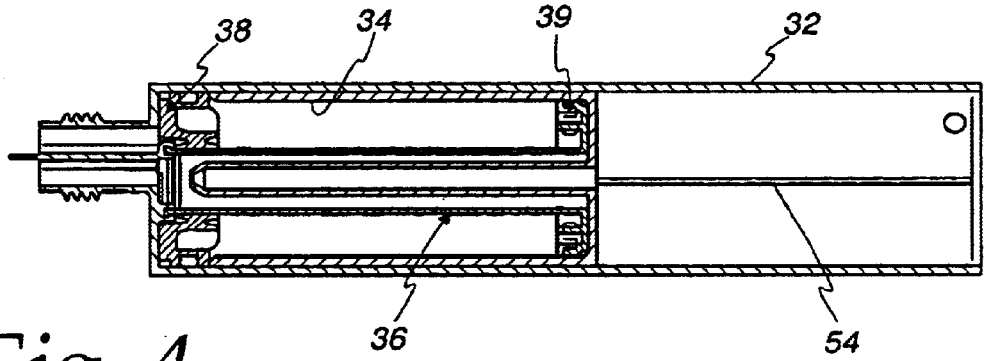
Fig. 4
(EMPTY)
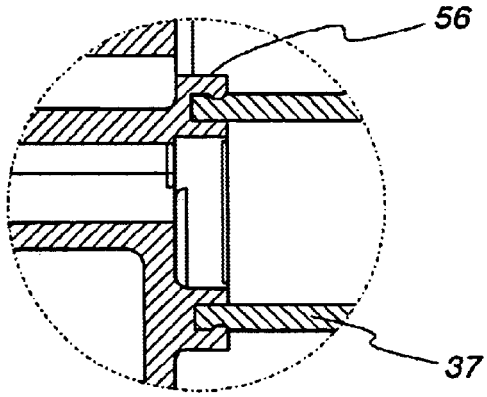
Fig. 5

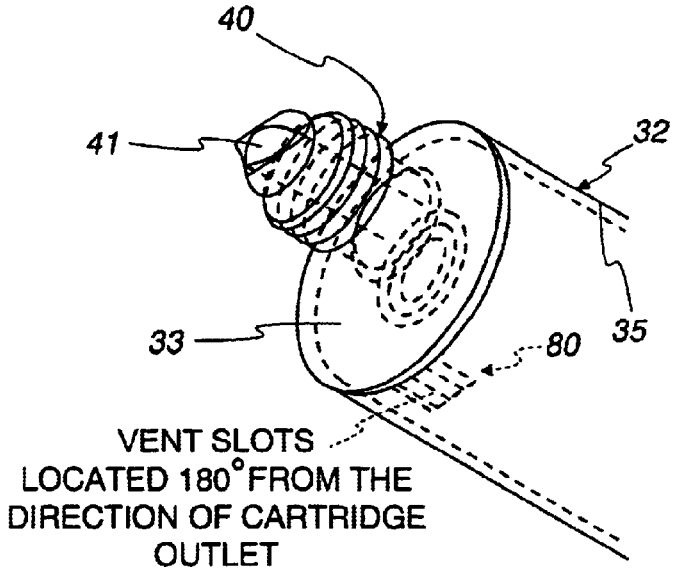
Fig. 18
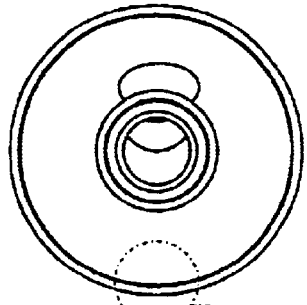
Fig. 19
OUTER CARTRIDGE
VIEW, FROM
THE OPEN END
DETAIL
Fig. 20
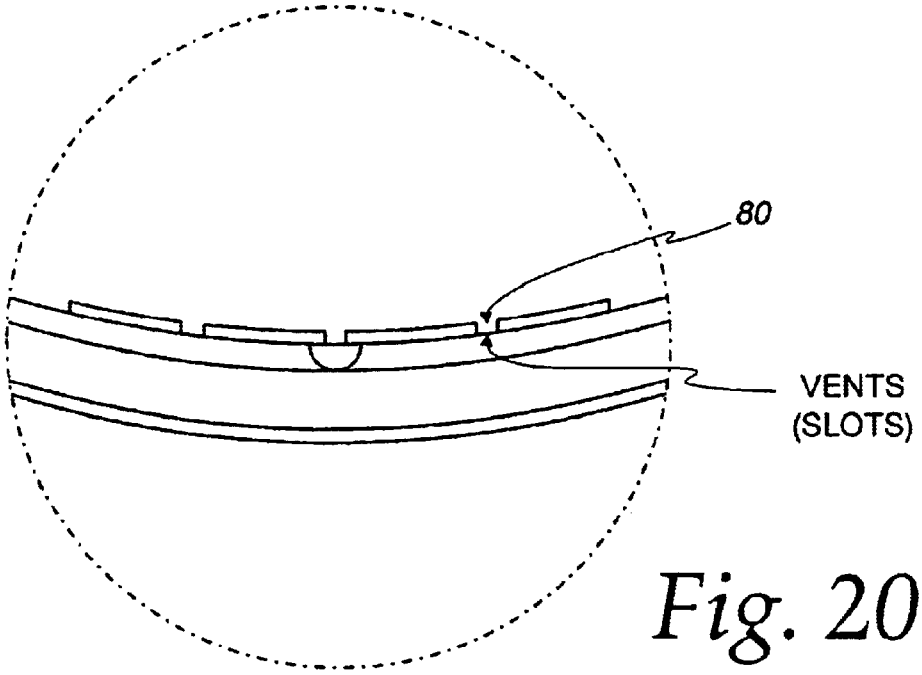
Fig. 20

FILLING PROCESS FOR DUAL FLUID CARTRIDGE ASSEMBLIES

CROSS REFERENCE TO RELATED APPLICATIONS

This application claims priority to International Patent Application No. PCT/US03/17997.

BACKGROUND OF THE INVENTION

1. Technical Field

The present invention relates to a filling process and more particularly to a filling process for automatically filling dual fluid cartridge assemblies.

2. Description of the Prior Art

Fluid cartridge assemblies are generally known in the art. Both single and multiple fluid cartridge assemblies are known. An example of a single fluid cartridge assembly is disclosed in commonly owned international patent application number PCT/US02/39041, filed on Dec. 6, 2002. Such a fluid cartridge assembly is used to dispense a single fluid.

Dual fluid cartridge assemblies are also known. Examples of such dual fluid cartridge assemblies are disclosed in U.S. Pat. Nos. 4,220,261; 4,961,520; and 5,310,091. Such dual fluid cartridge assemblies are known to be used to dispense fluid materials, such as thermoset adhesives, which typically contain two fluids that need to remain separated and applied to a workpiece quickly after mixing.

U.S. Pat. No. 5,310,091 discloses a dual fluid cartridge assembly configured with a front and rear chamber formed by an inner cartridge and an outer cartridge, respectively. Upper and lower piston seals are used to separate the fluids within the cartridges. Movement of the inner cartridge, for example, under the influence of a plunger of a conventional caulking gun, causes the inner cartridge to advance axially within the outer cartridge. The inner cartridge is in fluid communication with a hollow delivery tube which extends through a front chamber up to a cartridge outlet nozzle. Movement of the inner cartridge within the outer cartridge causes fluids in the inner cartridge and outer cartridge to be dispensed.

A problem exists with filling such cartridges. In particular, it is normally necessary to bleed air from the cartridge to prevent air from being trapped within the cartridge during filling. Such trapped air is known to have a negative impact on the ability to control the volumetric ratio of the fluids dispensed. If air is trapped in the inner cartridge, for example, the initial movement of the piston seals and accompanying increase in pressure in the cartridge chamber will act will cause that air to be compressed rather than to force fluid out of the outlet of the cartridge. Therefore, as the pressure in the cartridge increases during the early phase of the dispensing cycle, a smaller amount of the fluid in the inner cartridge will be dispensed than is desired. As the pressure in the cartridge decreases later, the air still trapped in the inner cartridge will expand and cause a larger than desired amount of fluid to be dispensed from the inner cartridge during the later phase of the dispensing cycle. If a different amount of air is trapped in the outer cartridge, the air will compress and expand at different rates than that of the air in the inner cartridge chamber. The difference in these rates will cause variation in the ratio of the fluids dispensed from the two cartridge chambers. This variation may have a negative impact on the performance of the fluids to be mixed.

To avoid this problem, various methods are known for removing air from the cartridge chambers after filling, during piston insertion. For example, shims or wires are known to be automatically inserted adjacent the piston seal prior to piston insertion and used as a method for bleeding air from the cartridge. The shims are removed after the pistons are inserted. This method is known to be used with relatively high viscosity fluids.

Unfortunately, there are several problems associated with this method. First, the shims can become fouled by way of contact with a fluid, thus eliminating or reducing the effectiveness of the shims. Second, the shims and wires are prone to breaking and curling due to their relatively small cross sections. Third, such shims and wires must be replaced periodically. Fourth, burrs and sharp edges along the length of the shims are known to damage the piston seal and thus affect its performance. Lastly, the use of wires or shims requires extra steps and thus increases the cost of filling the cartridge assembly.

Another known method for removing air from a cartridge before filling is use of a vacuum. Unfortunately, since it takes time to draw a vacuum, this approach increases the time required to fill the cartridge.

Finally, some systems are known to employ bleed plugs which include a vent for allowing air to escape. With this type of system, the vent is plugged after all of the air has been expelled between the piston and fluid within the cartridge. Unfortunately, such systems require additional steps and components and thus increase the time and cost of filling such cartridges. Thus, there is a need for a cartridge filling method which allows the cartridges to be filled quickly and easily while bleeding air from the cartridges without the need for extra steps or the need for a vacuum.

SUMMARY OF THE INVENTION

The present invention relates to a method for automatically filling a fluid cartridge assembly which automatically bleeds air from the cartridge prior to filling with less steps relative to known filling methods and without the need for a vacuum. The process relates to providing a self-bleeding dual fluid cartridge assembly which includes vents that bleed air from the cartridges initially and automatically closes the vents as the piston seal moves away from the vent. By utilizing such a self-bleeding cartridge assembly, the cartridge can be filled by an automatic fluid dispenser without the need for shims, a vacuum or bleed plugs.

DESCRIPTION OF THE DRAWINGS

These and other advantages of the present invention will be understood with reference to the following specification and attached drawing wherein:

FIG. 2 is a front view of a dual fluid cartridge assembly in accordance with the present invention.

FIG. 3 is a sectional view along a line 3—3 of FIG. 2, illustrating the dual fluid cartridge assembly in accordance with the present invention in a filled position.

FIG. 4 is similar to FIG. 3 but illustrating the dual fluid cartridge assembly in an empty position.

FIG. 5 is an enlarged detailed view illustrating the connection between an inner cartridge tube and a nose outlet in accordance with the present invention.

FIG. 18 is a partial perspective view of the outer cartridge in accordance with the present invention illustrating slots for providing an air vent for the outer cartridge in accordance with another aspect of the present invention.

FIG. 19 is a plan view of an open end of the outer cartridge illustrated in FIG. 18.

FIG. 20 is an enlarged detailed view of a portion of the outer cartridge illustrating the vent slots.

DETAILED DESCRIPTION

The present invention relates to a method for filling a dual fluid cartridge assembly which automatically fills and bleeds the cartridge assembly prior to filling without additional steps and without a vacuum. Unlike other known methods for filling dual fluid cartridge assemblies, the method in accordance with the present invention utilizes an automatic filling machine in conjunction with a self-bleeding dual fluid cartridge assembly that is configured with a vent to atmosphere which allows air in the inner cartridge to be automatically evacuated during the fill process in order to prevent any trapped air pockets within the fluid in the inner cartridge. A vent may also be optionally provided in order to vent trapped air from the chamber formed by the outer cartridge as well.

Figure 21:
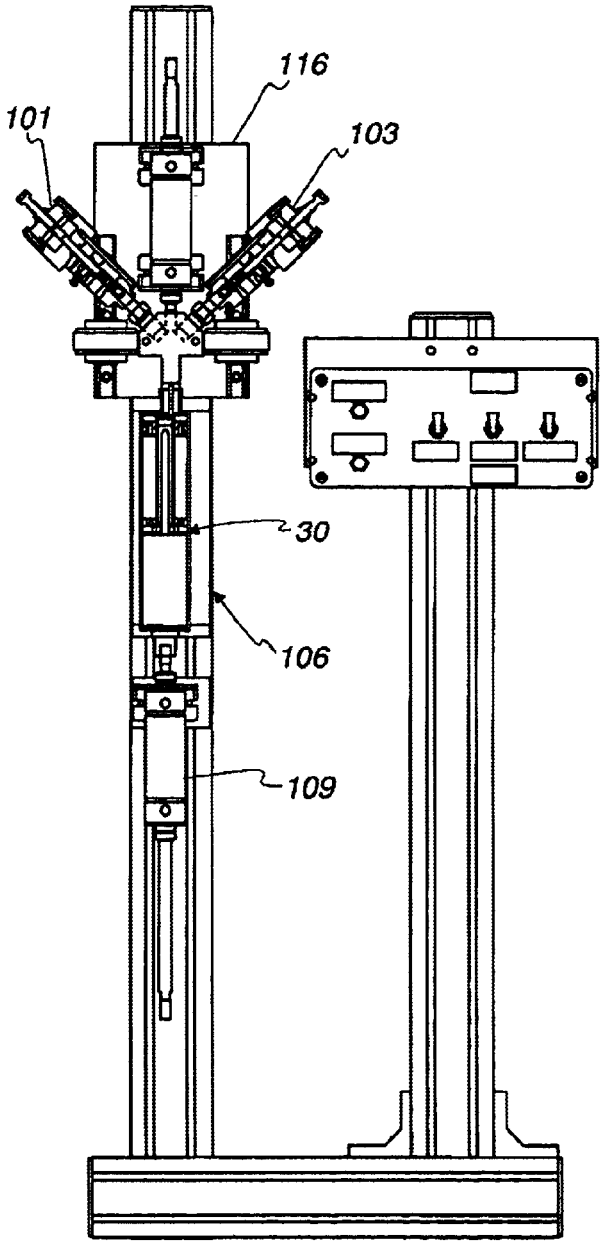
FIG. 21 is a side view of an automatic filling station for use in accordance with the present invention.
Figure 22:
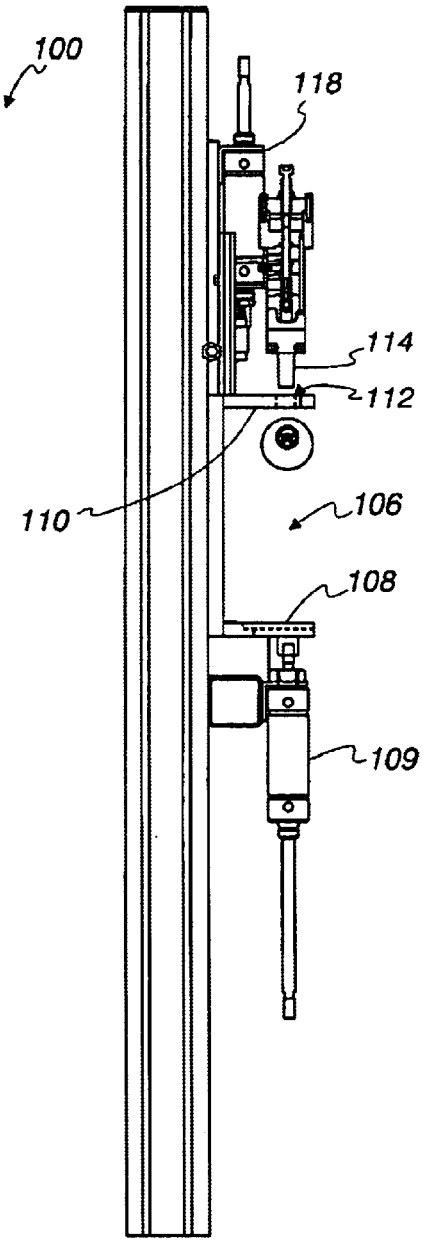
FIG. 22 is similar to FIG. 21 but represents a front view.

The method in accordance with the present invention is adapted to be utilized with a dual fluid cartridge assembly as illustrated in FIGS. 2–20 and described below. An exemplary filling machine for automatically filling the dual fluid cartridge assembly is illustrated in FIGS. 21 and 22 and is also described below.

Dual Fluid Cartridge Assembly

Referring first to FIGS. 2–20, a dual fluid cartridge assembly for use with the filling process in accordance with the present invention is illustrated. In accordance with an important aspect of the invention, the dual fluid cartridge assembly 30 is provided with a vent path to atmosphere which allows air in the inner cartridge and optionally the outer cartridge to be evacuated to atmosphere during filling of the inner and outer cartridges to prevent trapped air pockets therein. Such trapped air pockets are known to result in voids in the fluid in the inner and outer cartridges resulting in non-homogeneous mixing of the fluids thereby decreasing the performance of the fluids.

FIG. 3 illustrates the dual fluid cartridge assembly 30 in a filled position, while FIG. 4 illustrates the dual fluid cartridge assembly 30 in an empty position. As shown the dual fluid cartridge assembly 30 includes an outer cartridge 32, an inner cartridge 34, an integral piston seal and delivery tube 36 having a lower seal 39; and an upper piston seal 38.

In accordance with an important aspect of the invention, a vent path to atmosphere is provided from the inner cartridge 34 when the inner cartridge 34 is in an empty position, as illustrated in FIG. 4. Filling of the inner cartridge 34 is done by way of a cartridge outlet nozzle 40. The cartridge outlet nozzle 40 is formed as a tubular member with an axial separator wall 41, which forms two side by side chambers for enabling filling of each of the fluids. In order to fill the inner cartridge 34, fluid is applied through the cartridge outlet nozzle 40 through the piston tube 36 into a chamber forming the inner cartridge 34, beginning when the inner cartridge 34 is in the position shown in FIG. 4 until the inner cartridge is full. Similarly, the outer cartridge 32 is also filled by way of the cartridge outlet nozzle 40.

Figure 6:
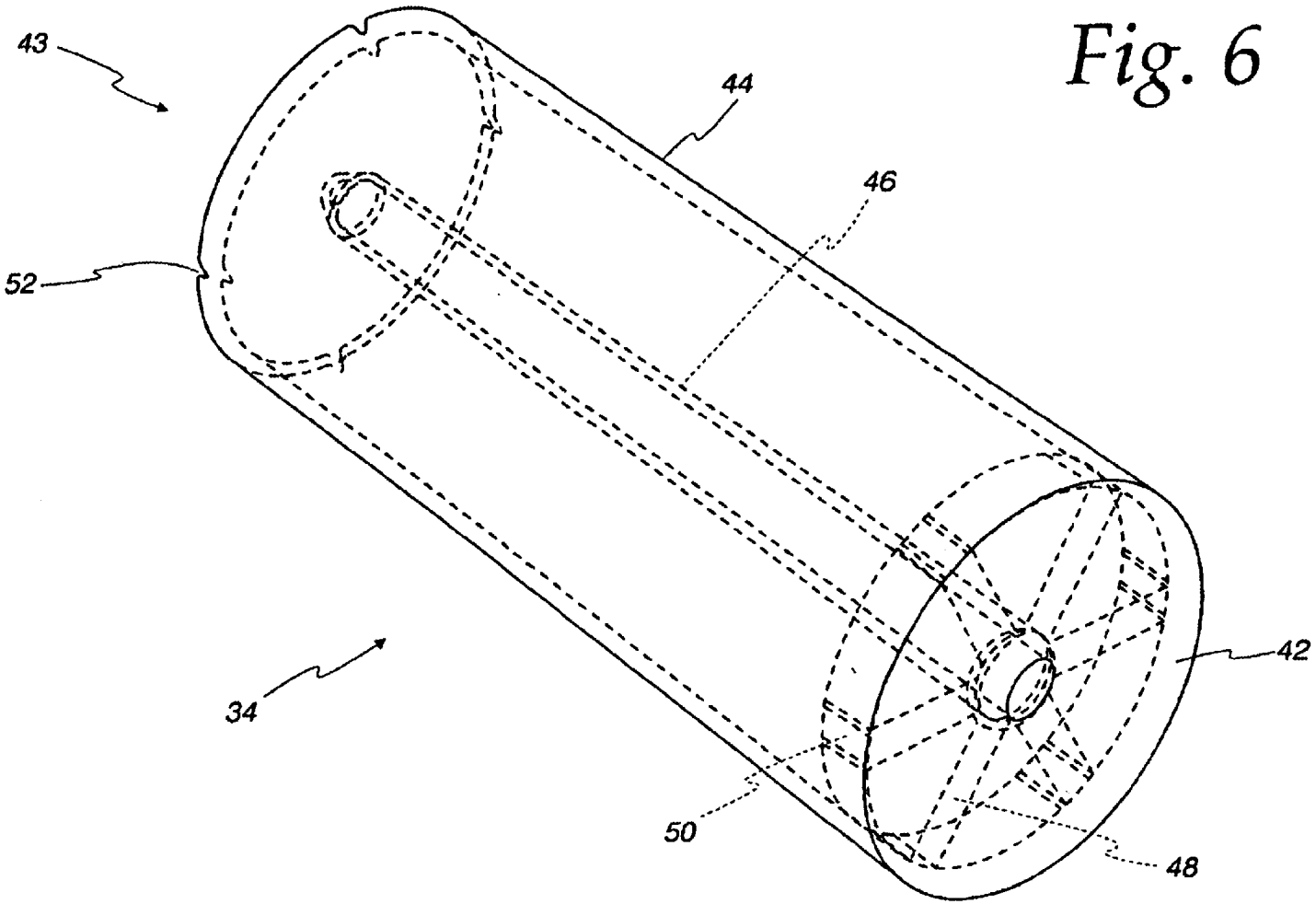
FIG. 6 is a partial simplified view of the air vent path formed in the inner cartridge in accordance with the present invention.
Figure 7:
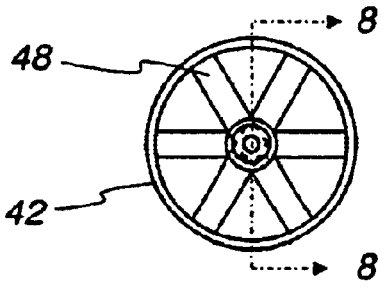
FIG. 7 is a right side view of an inner cartridge in accordance with the president invention illustrating a number of radial slots formed in a base portion of the inner cartridge.
Figure 8:
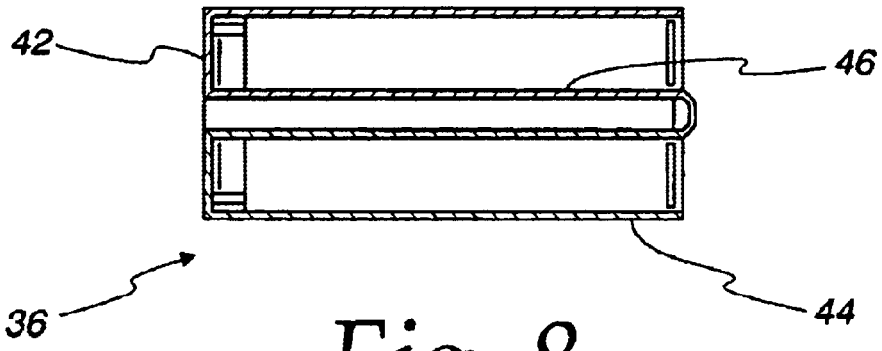
FIG. 8 is a sectional view along line 8—8 of FIG. 7 illustrating the inner cartridge in accordance with the present invention.
Figure 9:
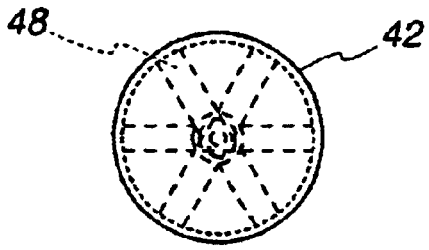
FIG. 9 is a left side view of the inner cartridge in accordance with the present invention.
Figure 11:
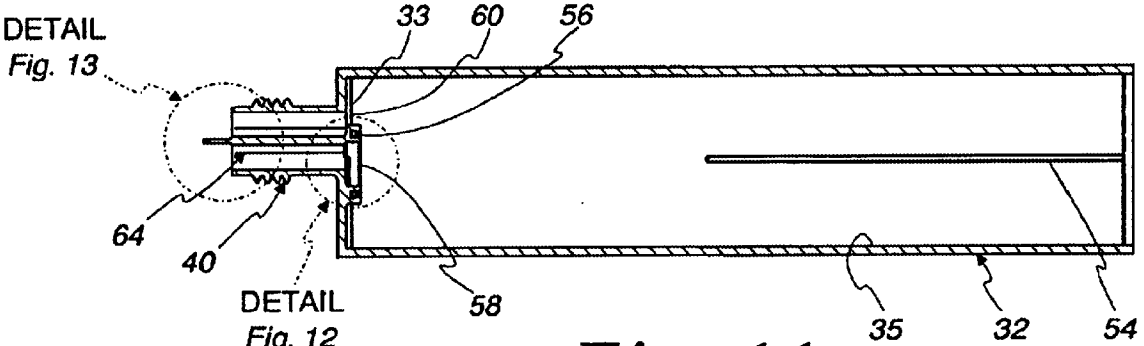
FIG. 11 is a section view along line 11—11 of FIG. 10 of the outer cartridge in accordance with the present invention.
Figure 13:
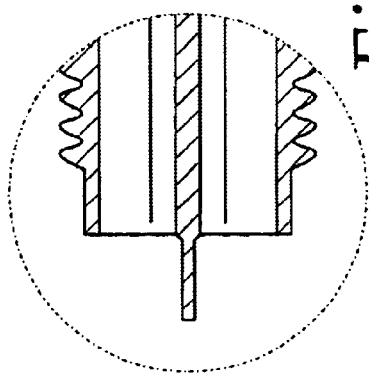
FIG. 13 is an enlarged view of the outer nose outlet portion of the outer cartridge in accordance with the present invention.
Figure 10:
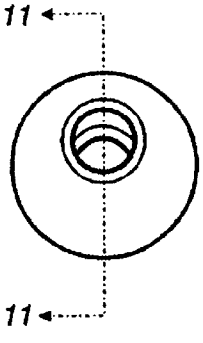
FIG. 10 is a left side view of an outer cartridge in accordance with the present invention.

Turning to FIGS. 6–9, the inner cartridge 34 includes a circular base plate 42 and a cylindrical sidewall 44. A separator rod 46 projects upwardly from the base plate 42 and extends to a mouth 43 of the cylindrical sidewall 44 of the inner cartridge 34. Slots, for example, radial slots, generally identified with the reference numeral 48, are formed in the base plate 42 of the inner cartridge 34. As best shown in FIG. 6, the slots 48 formed in the base plate 42 of the inner cartridge 34 extend partially up the sidewall 44 in an axial direction, as indicated by the reference numeral 50. As best shown in FIGS. 4, 6 and 11, the slots 48 and 50 allow trapped air in the inner cartridge 34 to escape up along the sidewall 44 of the inner cartridge 34 and bleed to the outside of the inner cartridge 34 by way of one or more notches 52, formed at the mouth 43 of the inner cartridge 34. Air escapes by way of clearance between the outside diameter of the inner cartridge 34 and the inside diameter of the outer cartridge. As the inner cartridge 34 moves away from the (stationary) lower seal 39 the vent path is closed.

Figure 12:
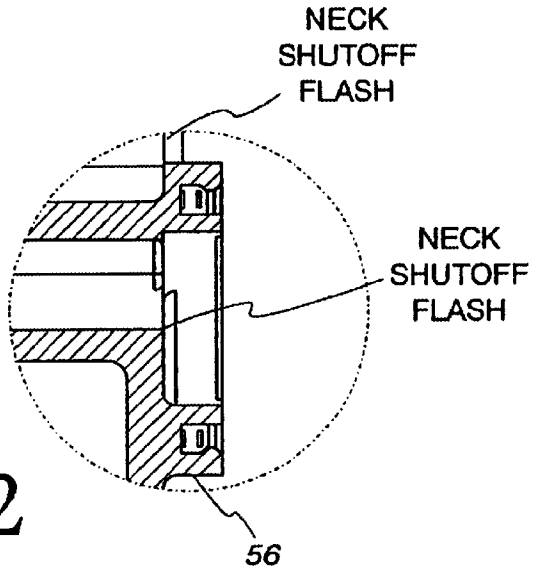
FIG. 12 is an enlarged detailed view of the inner nose outlet portion of the inner cartridge in accordance with the present invention.

FIGS. 10–13 illustrate the outer cartridge 32. As shown, the outer cartridge 32 is formed as a cylindrical member having a base plate 33 and a cylindrical sidewall 35 with a diameter slightly larger than the diameter of inner cartridge 34 to allow free axial movement of the inner cartridge 34 therewithin. The outer cartridge 32 is formed with the cartridge outlet 40 used for filling and dispensing the fluids from the inner cartridge 34 and outer cartridge 32. As shown in FIGS. 3, 5 and 12, the outer cartridge 32 includes an offset flange 56 for connection to the piston tube 36. As shown best in FIG. 5, the connection between the offset flange 56, the outer cartridge 32 and the piston seal and delivery tube 36 may be a snap connection. A delivery tube portion 37 of the piston seal and delivery tube 36 forms a conduit from the inner cartridge 34 to the nose portion 40. Fluid in the outer cartridge 32 is dispensed into an offset opening 60. Accordingly, the offset openings 58 and 60 formed along an inner wall 33 of the outer cartridge 32 together with the separator wall 41 (FIG. 2) allow the fluid from the inner cartridge 34 and the outer cartridge 32 to be discharged side by side out of the cartridge outlet nozzle 40.

Figure 14:
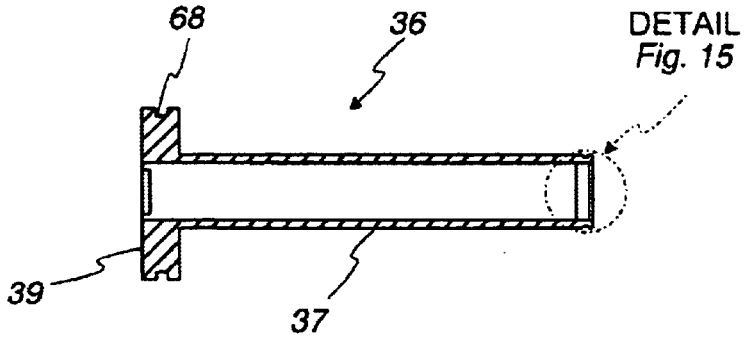
FIG. 14 is a sectional view of a piston seal and delivery tube in accordance with the present invention.
Figure 15:
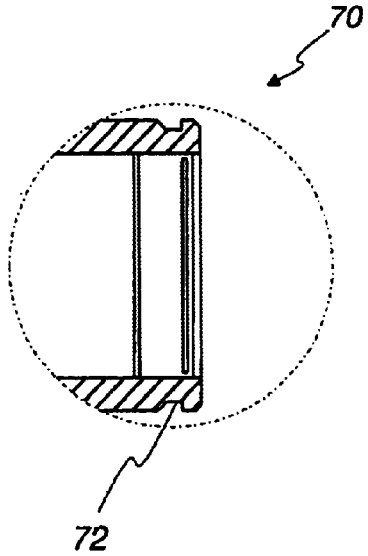
FIG. 15 is an enlarged sectional view of the one end of the delivery tube in accordance with the present invention.

FIGS. 14 and 15 illustrate the piston seal and delivery tube 36. As mentioned above, the piston seal and delivery tube 36 includes an elongated tube 37 and a lower piston seal 39. The lower piston seal 39 of the piston seal and delivery tube 36 may be formed, for example, with a circumferential slot 68 for receiving and an O-ring (not shown). The lower seal portion 39 seals the fluid in the inner cartridge 34 from the rest of the assembly 30. As mentioned above, an extending end 70 of the piston tube 36 may be formed with a circumferential slot 72, adjacent the extending end 70. As mentioned above and as illustrated in FIG. 5, this circumferential slot 72 cooperates with a mating slot formed in the flange 56 (FIG. 5) to provide a snap connection between the piston tube 36 and the flange 56.

Figure 16:
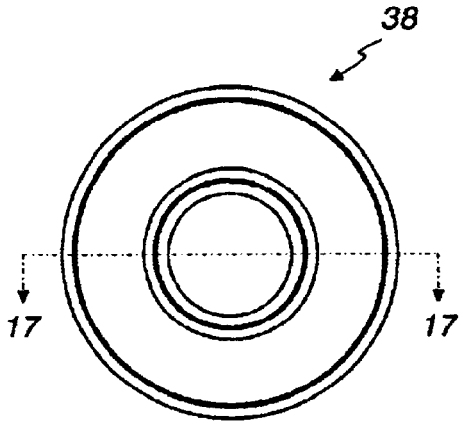
FIG. 16 is a top view of an upper piston seal for use with the present invention.
Figure 17:
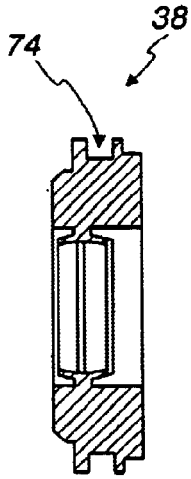
FIG. 17 is a sectional view along lines 17—17 of FIG. 16.

FIGS. 16 and 17 illustrate the upper seal 38. The upper seal 38 seals the fluid in the outer cartridge 32. As shown, the upper seal 38 may be provided with a circumferential slot 74 for receiving an O-ring (not shown). The seals 38 and 39 may alternatively be formed with equivalent configurations, such as radial extending lips or a combination of o-rings and radial extending lips.

In accordance with another aspect of the invention, the cartridge assembly 30 is optionally configured with another vent path for venting air from the outer cartridge 32 to atmosphere to avoid trapping air in the outer cartridge 32. In particular with reference to FIGS. 18 through 20, one or more vent slots 80 may optionally be formed on the interior of the cylindrical sidewall 35 of the outer cartridge 32. These vent slots 80 extend from the base plate 32 (FIGS. 11 and 18) and extend in an axial direction, as shown in FIG. 18. The vent slots 80 may be disposed in a direction, for example, 180 degrees from the direction of the cartridge outlet offset, as generally shown in FIG. 18. Thus, when the upper seal 38 is in a position as shown in FIG. 4, the axial slots 80 provide a vent path around the upper seal 38 which allows air from the outer cartridge 32 to be vented by way of clearance between the outside diameter of the inner cartridge 34 and the inside diameter of the outer cartridge. As soon as the upper seal 38 is out of engagement with the axial slots 80, the vent path for the outer cartridge 32 is closed.

Figure 1:
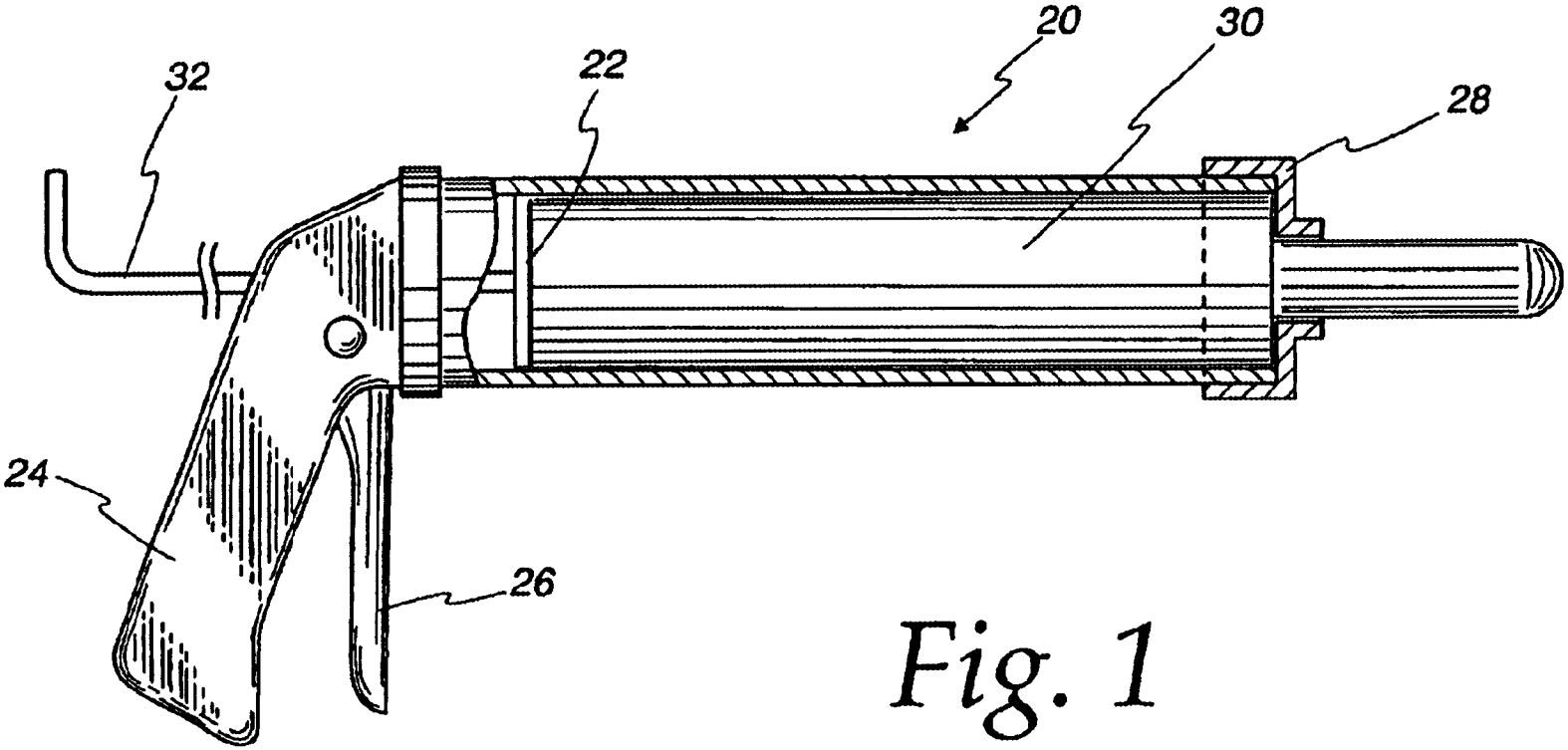
FIG. 1 is an elevational view of a conventional cartridge gun shown in partial cutaway illustrating a dual fluid cartridge assembly in accordance with the present invention.

The fluids in the cartridge assembly 30 are dispensed by way of a conventional caulking gun 20, as shown in FIG. 1, which includes a plunger 22, a handle 24, a trigger 26 and a nose piece 28. In operation, as the plunger 22 advances in an axial direction toward the nose piece 28 of the caulking gun 20 (assuming a ratchet arm 32 is in the position shown in FIG. 1), the inner cartridge 34 moves in an axial direction toward the nose portion 40 (FIG. 3). As the inner cartridge 34 advances in an axial direction, fluid from the inner cartridge 34 is forced into the piston tube 36 and to the nose portion 40. Initially, as shown in FIG. 3, the upper seal and the piston seal 39 are side by side when the cartridge assembly 30 is full. As the inner cartridge 34 advances to the left as shown in FIG. 4, the inner cartridge 34 pushes the upper seal 38 to the left, which forces fluid in the outer cartridge 32 to be dispensed out the cartridge outlet 40. This axial movement of the inner cartridge within the outer cartridge results in dispensing of the fluids and application of the fluids to a work piece by way of a cartridge outlet and a nozzle, such as a static mixing nozzle, in a similar manner as disclosed in U.S. Pat. No. 5,310,091, hereby incorporated by reference.

Filling Method

The inner cartridge 34 is filled with a fluid by way of the cartridge outlet nozzle 40. In particular, a fill nozzle 114 (FIG. 22) is inserted in the cartridge outlet nozzle 40 and into the inlet opening 58 (FIG. 11). As discussed above, the inlet opening 58 is in fluid communication with the delivery tube portion 37 (FIG. 5) of the piston seal and delivery tube 36 (FIG. 4), which, in turn, is in fluid communication with the inner cartridge 34 (FIG. 3). When the inner cartridge 34 is in the position as shown in FIG. 4, fluid is filled through the delivery tube portion 37 (FIG. 5) toward the bottom or base portion 42 (FIG. 6) of the inner cartridge 34. In the position shown in FIG. 4, the inner cartridge vent is open to atmosphere. In particular, in this position, as fluid fills the inner cartridge 34, air is pushed into the slots 48 (FIG. 6) in the base portion 42 of the inner cartridge 34. As the fluid continues to fill the inner cartridge 34, air is pushed up through the axial slots 50 and bleeds through the notches 52 formed in the mouth 43 of the inner cartridge 34, to atmosphere.

After the inner cartridge 34 (FIG. 3) is filled, the outer cartridge 32 may be filled with a second fluid. The outer cartridge 32 is also filled by way of the fill nozzle 114 (FIG. 22)through the cartridge outlet nozzle 40 but through the opening 60 (FIG. 11). After the inner cartridge 34 and outer cartridge 32 are filled, a cap (not shown) may be used to close the cartridge outlet nozzle 40 of the cartridge assembly 30. Filling of the outer cartridge 32 may begin once the delivery tube 37 is filled with fluid and the air has been exhausted from the inner cartridge 34. Filling of the outer cartridge 32 must always lag filling of the inner cartridge 34 by a volume at least as large as the volume of the delivery tube 37 until the inner cartridge 34 has been filled completely, at which time the filling of the outer cartridge 32 can catch up. This is important to prevent air from getting sucked into the inner cartridge 34 if the filling of the inner cartridge 34 gets ahead of it. Second, the same vent groove method may be used to bleed air from the outer cartridge 32 as the method described for use in the inner cartridge 34.

An exemplary automatic filling machine is illustrated in FIGS. 21 and 22 and identified with the reference numeral 100. The filling machine 100 may be, for example, a Model No. BH-DUAL CMP-632×9 by Adhesive Systems Technology Corporation of New Hope, Minn., as described in detail in their CMP Series Instruction Manual AST #60000049, hereby incorporated by reference. Other filling machines may also be used.

FIG. 22 illustrates a side view while FIG. 21 illustrates a front view of the filling station 100. FIG. 21 is shown with a dual fluid cartridge assembly 30 loaded into the filling station 100.

The filling machine 100 is adapted to be used with two (2) gravity fed reservoirs (not shown)— one for each fluid—and two (2) independent metering pumps (not shown). The metering pumps are coupled to a pair of metering valves 101 and 103 (FIG. 21) on the filling station 100 by way of flexible conduits (not shown).

As best shown in FIG. 22, the filling station 100 includes a fixture 106 for carrying the dual fluid cartridge assembly 100. The fixture 106 includes a lower plunger 108 for pushing the inner cartridge 34 to the EMPTY position as shown in FIG. 4 by way of an air cylinder 109 and holding the inner cartridge 34 in that position. This action holds the vent grooves (50) in communication with the lower seal 39 until all the air in the delivery tube 37 and inner cartridge 34 has been replaced by fluid.

The fixture 106 also includes an upper horizontal member 110. The horizontal member 110 includes an aperture 112 for receiving a fill nozzle 114, mounted on a movable member

116. Subsequently a button (not shown) is depressed by the operator to begin the cycle. Other embodiments contemplate a proximity sensor that senses the presence of the cartridge as a trigger to begin the filling cycle. After the cycle is initiated by depressing the button, an air cylinder 118 causes the vertical member 116 and the fill nozzle 114 to move downwardly and fully engage and seal the cartridge outlet nozzle 40 (FIG. 18). The fill nozzle 114 enables fluids to be pumped into the offset openings 58 and 60 (FIG. 11) of the dual fluid cartridge assembly 30.

In operation, the cartridge outlet nozzle 40 is manually registered and mated with the fill nozzle 114. The air cylinder 118 pushes the movable member 116 and the fill nozzle 114 downwardly. The other air cylinder 109 pushes the plunger 108 upwardly which causes the inner cartridge 34 to move to the EMPTY position as shown in FIG. 4. The air cylinder 109 holds the inner cartridge 34 in the EMPTY position while the air is bled out of it, as discussed above. In particular, as the metering pump begin to pump fluid from the fluid reservoir, air is bled from the inner cartridge 34 as discussed above. Once a predetermined and adjustable volume of fluid has been pumped into the inner cartridge 34, the air cylinder 109 releases the inner cartridge 34. A continued inflow of fluid causes the inner cartridge 34 to move away from the EMPTY position, as illustrated in FIG. 4, and close the vent to atmosphere. Subsequently, fluids may be pumped individually or simultaneously into the inner cartridge 34 and the outer cartridge 32. The metering pumps dispense a preset amount into each of the inner cartridge 34 and the outer cartridge 32. After the inner cartridge 34 and outer cartridge 32 are filled, the vertical member 116, under the influence of the air cylinder 118, returns to the home position, as shown in FIG. 22, to enable the filled cartridge to be removed.

Obviously, many modifications and variations of the present invention are possible in light of the above teachings. Thus, it is to be understood that, within the scope of the appended claims, the invention may be practiced otherwise than as specifically described above.

What is described to be secured by a Letters Patent is covered by the appended claims.

What is claimed is:

1. A process for filling a dual cartridge assembly, the process comprising the steps of:

(a) providing a dual fluid cartridge assembly which includes an inner cartridge, an outer cartridge and a lower piston seal for sealing the inner cartridge and an upper piston seal for sealing the outer cartridge, both piston seals movable between an EMPTY position and a FILLED position, said dual fluid cartridge assembly having a vent open to atmosphere in said EMPTY position and closed when said lower piston seal is away from said EMPTY position;

(b) moving said piston seal to said EMPTY position to allow trapped air in said inner cartridge to be vented to atmosphere;

(c) filling said inner cartridge with a first fluid which causes said lower seal to move away from said EMPTY position and close the vent; and (d) filling the outer cartridge with a second fluid.

2. The process as stated in claim 1, wherein said inner and outer cartridges are filled with first and second fluids at the same time.

3. The process as recited in claim 1, wherein said inner and outer cartridges are filled with first and second fluids at different times.

* * * * *